United States Patent [19]

Berkowitz

[11] 3,945,343

[45] Mar. 23, 1976

[54] MAGNETIC BRUSH FOR USE IN MAGNETIC PRINTING

[75] Inventor: Ami E. Berkowitz, Schenectady, N.Y.

[73] Assignee: General Electric Company, Schenectady, N.Y.

[22] Filed: Mar. 24, 1975

[21] Appl. No.: 561,668

[52] U.S. Cl. ..... 118/623; 427/48

[51] Int. Cl.[2] ..... G03G 19/00

[58] Field of Search ..... 118/623, 621, 639, 637; 427/18, 47, 48, 128; 346/74.1; 101/DIG. 5

[56] References Cited

UNITED STATES PATENTS

| | | | |
|---|---|---|---|
| 3,318,284 | 5/1967 | Hojo et al. | 118/637 |
| 3,402,698 | 9/1968 | Kojima et al. | 118/637 |
| 3,626,898 | 12/1971 | Gawron | 118/637 |
| 3,643,629 | 2/1972 | Kangas et al. | 118/637 |
| 3,739,749 | 6/1973 | Kangas et al. | 118/637 |
| 3,828,730 | 8/1974 | Yamashita et al. | 118/637 |
| 3,839,992 | 10/1974 | Takahashi | 118/623 |
| 3,879,737 | 4/1975 | Lunde | 118/637 |

*Primary Examiner*—Mervin Stein
*Assistant Examiner*—Douglas Salser
*Attorney, Agent, or Firm*—Jack E. Haken; Joseph T. Cohen; Jerome C. Squillaro

[57] ABSTRACT

An improved magnetic brush for transferring toner to a latent image in a magnetic printing machine comprises a rotatable applicator cylinder disposed around a multipole magnetic stator. The two poles of the stator lying closest to the image are excited with magnetic fields of like polarity to minimize interaction between the magnetic brush field and the recorded magnetic image.

8 Claims, 4 Drawing Figures

MAGNETIC BRUSH FOR USE IN MAGNETIC PRINTING

BACKGROUND OF THE INVENTION

This invention relates to structures for distributing toner in magnetic printing machines. More specifically, this invention relates to magnetic brush structures for transferring dry particulate toner to latent images on magnetic recording media.

Magnetic printing techniques are well known to the copier and facsimile arts. In a typical magnetic printing machine, electrical signals are applied to magnetic recording heads which induce magnetic field variations in the surface of a moving, magnetic recording medium. The field variations produce a latent magnetic image on the surface of the recording medium which is adapted for attracting and retaining magnetic ink particles. An ink toner, which may be in dry particulate form, is applied to the latent magnetic image and may be transferred to paper or other hard copy media. In many respects, magnetic printing is similar to the more common electrostatic, or xerographic, printing wherein toner particles are attracted to the electric fields created by latent charge image on a dielectric medium.

High quality magnetic printing requires that the toner particles be uniformly distributed on the surface of the recording medium. The toner consists of highly mobile, dust-like particles and care must be taken to prevent the spread of these particles to other components of the printing system with resultant degradation of the printed image.

Magnetic brush structures have, for many years, been utilized for the transfer of toner in electrostatic printing machines. The toner, comprising ferromagnetic materials and insulating resins, is attracted to the surface of a hollow, applicator cylinder rotatably disposed around a magnetic core. The magnetic core structure rotates with respect to the surrounding cylinder and carries the magnetic particles to the image surface in its magnetic field. More recently, magnetic brush structures having a fixed magnetic stator and a rotating applicator cylinder have been utilized. U.S. Pat. No. 3,553,464 to Abe describes a typical magnetic brush having a rotating core while U.S. Pat. No. 3,643,629 to Kangas describes magnetic brush systems having rotating applicator cylinders.

The magnetic brush structures of the prior art, while suitable for the application of toner to electrostatic latent images, produce strong magnetic field components in the plane of the recording medium surface. These field components will distort and erase the magnetic latent image in a magnetic printing machine and prevent the use of prior art magnetic brush structures in such magnetic printing machines.

SUMMARY OF THE INVENTION

In accordance with the present invention I provide a magnetic brush structure producing magnetic field components in the image plane which are greatly reduced with respect to the magnetic field components of prior art structures. Furthermore, the magnetic field components of the present invention are normal to the image plane and to the magnetic field components of the magnetic latent image and thus have reduced tendencies for interaction with the latent image.

The magnetic brush structure of the present invention comprises an applicator cylinder rotatably affixed around a multi-pole magnetic stator. The stator has a generally multilobe prismatic form; the lobes being energized with different magnetic polarities by permanent magnet or electromagnet energy sources. The two lobes disposed closest to the magnetic latent image are energized with like magnetic polarities and are disposed in a plane parallel to the plane of the magnetic latent image. The remaining poles are symmetrically disposed about the applicator cylinder axis with alternating polarity.

The applicator cylinder rotates around the stator and through a supply of ferromagnetic toner particles which are attracted to and form a layer on its surface. The surface of the tone particle layer is shaped by a doctor blade and carried adjacent to the latent magnetic image at which point inking is effected.

It is, therefore, an object of this invention to provide a magnetic brush structure which is suitable for use in magnetic printing machines.

Another object of this invention is to provide a magnetic brush structure having magnetic field components which are normal to the plane of a latent magnetic image.

Yet another object of this invention is to provide a magnetic brush structure, for use in magnetic printing systems, wherein magnetic field components at the latent image plane are reduced with respect to the magnetic field components of prior art brushes.

BRIEF DESCRIPTION OF THE DRAWINGS

The novel features of this invention sought to be patented are set forth with particularity in the appended claims. The invention, together with further objects and advantages thereof, may be understood from a reading of the following specification and appended claims in view of the accompanying drawing in which:

DESCRIPTION OF THE PREFERRED EMBODIMENT

Figures 1, 2:
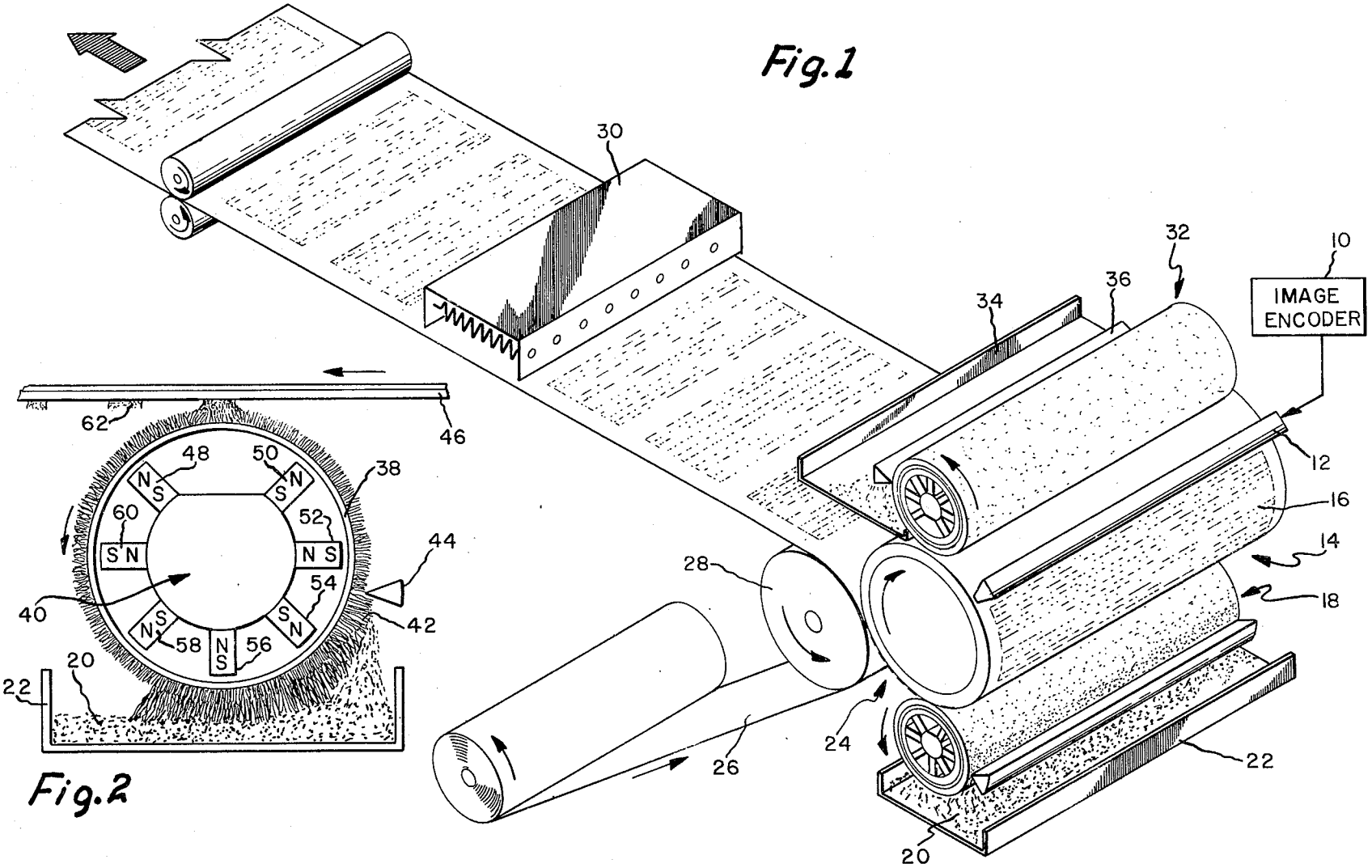
FIG. 1 is a typical magnetic printing system incorporating magnetic brushes of the present invention.
FIG. 2 is an end view of a magnetic brush in accordance with the present invention.

FIG. 1 is a typical magnetic printing system incorporating two magnetic brushes of the present invention. For purposes of illustration, the magnetic printing system of FIG. 1 comprises a rotating magnetic drum as a magnetic recording medium. It is to be understood, however, that the magnetic brushes of the present invention may be utilized with magnetic printing systems incorporating other forms of magnetic recording media; for example, moving magnetic recording tape. Likewise, although the printing system of FIG. 1 incorporates two magnetic brushes of the present invention, magnetic printing systems may be constructed utilizing only one magnetic brush of the present invention.

An image encoder 10 produces electrical signals representative of the brightness in an original image. The imaging encoder 10 may, for example, comprise an optical scanner for encoding scene information or may comprise an electronic character generator for producing type font information. Signals from the imaging encoder 10 are applied to a magnetic recording head 12 which produces therefrom a magnetic field with spatial variations corresponding to the brightness of the encoded image. The magnetic field created by the recording head 12 impinges on the surface of a moving magnetic recording medium; in this embodiment a rotating magnetic drum 14. The magnetic field variations induce a latent magnetic image 16 on the surface of the drum 14 which corresponds to the brightness of the original image.

The moving surface of the drum 14 carries the latent magnetic image 16 past a first magnetic brush 18. The brush 18, more fully described below, functions to transfer dry particulate toner 20 from a reservoir 22 to the latent magnetic image 16 on the surface of the drum 14. The toner particles 20 are attracted by the magnetic field variations of the latent image 16 on the surface of the drum 14, and adhere to the surface of the drum forming a toner image 24.

The toner image 24 is transferred from the surface of the drum 14 to a hard copy medium 26 which may, for example, be paper. In the magnetic printing system of FIG. 1, the toner image is transferred by pressure exerted by roller 28 on the copy medium 26 and the toner image 24. It should be understood, however, that any conventional method of toner transfer may be used in this magnetic printing system, for example electrostatic transfer. The toner image on the surface of the copy medium 26 is then fixed to the surface of the medium; for example, in a fusing oven 30.

A second magnetic brush 32 is positioned adjacent to the surface of the magnetic drum 14 after the pressure roller 28. The second magnetic brush 32 serves to attract and remove residue toner particles from the surface of the drum 14. The toner particles are removed from the surface of the second brush 32 by a doctor blade 36 and collected in a container 34.

The first magnetic brush 18 operates in close proximity to the surface of the magnetic drum 14 in which is recorded the latent image 16. It is necessary, therefore, that any magnetic field created by the operation of the first magnetic brush 18 have a magnitude and orientation which will not affect, distort, or erase the magnetic latent image 16 on the surface of the drum. In many printing operations, the latent magnetic image 16 is repetitively inked by the first magnetic brush 18 to produce multiple copies. In that case, it is necessary that any magnetic fields associated with the operation of the second magnetic brush 32 be of a sufficiently small magnitude and oriented so as not to affect the latent magnetic image 16 in the surface of the magnetic drum 14.

Further details of the magnetic brushes of FIG. 1 are illustrated in the end view of FIG. 2. A rotatable applicator cylinder 38 comprises materials of low magnetic permeability which are selected in the manner described in the above-referenced patents. Typically, the applicator cylinder 38 may comprise brass or aluminum. The cylinder rotates about a magnetic stator 40 in the form of a multi-lobed prism aligned with the axis of the cylinder 38. The stator 40 comprises two magnetic pole lobes 48 and 50 which are closest to the surface of an associated magnetic recording medium 46. The two closest lobes 48 and 50 are disposed in a plane lying parallel to the tangent of the applicator cylinder 38 at the point closest to the recording medium 46. The remaining lobes 52, 54, 56, 58, and 60 of the stator 40 are symmetrically disposed about the axis of the applicator cylinder 38. In the present preferred embodiment the stator 40 comprises seven magnetic pole lobes spaced at 45° relative separation about the cylinder 38 axis. The two lobes lying closest to the recording medium 48 and 50 are disposed at a relative angle of 90° about the axis of the cylinder 38.

The stator lobes 48–60 are energized with magnetic fields by any conventional method, for example, the lobes may comprise permanent magnets or may be equipped with electrical windings for the purpose of inducing electromagnetic fields. The induced magnetic field is oriented so that the outer faces of the two closest lobes 48 and 50 are energized with the same sense of magnetic polarity. In the preferred embodiment of FIG. 2, the outer faces of the lobes 48 and 50 are energized as north magnetic poles. The outer faces of the remaining magnetic poles 52–60 alternate in the sense of magnetic polarity in relation to their disposition about the cylinder axis.

The applicator cylinder 38 rotates past a reservoir 22 of dry, particulate, ferromagnetic toner 20. The toner particles are attracted to the surface of the applicator cylinder 38 and are, in a conventional manner, carried by the rotating cylinder 38 to form a layer 42 of toner particles on the surface of the cylinder 38. The height of the toner particle layer 42 above the surface of the cylinder is regulated by a doctor blade 44. By way of illustration only, in a typical magnetic brush of the present invention the thickness of the toner particle layer 42 on the surface of the rotating applicator cylinder 38 is regulated by the doctor blade 44 to approximately 5 mm.

The surface of the rotating applicator cylinder 38 carries the toner particle layer 42 proximate to the surface of the moving magnetic recording medium 46. Toner particles are attracted from the layer 42 by magnetic field variations in the surface of the recording medium 46 and form a toner image 62 on that surface. Relative motion between the surface of the rotating particle layer 42 and the surface of the recording medium 46 is not necessary to effect transfer of the toner particles. We have determined, however, that the spurious transfer of toner particles to the surface of the magnetic medium 46 may be reduced if the relative motions of the surface of the toner layer 42 and the surface of the magnetic recording medium 46 are parallel at the point of toner transfer.

The magnetic recording medium 46 in FIG. 6 has, for ease of illustration, been represented as a moving magnetic recording tape. It should be understood, however, that the magnetic brushes of the present invention may operate in printing systems with the magnetic medium is, for example, the magnetic drum 14 of FIG. 1 or any other medium commonly used in such systems.

The latent image is recorded in the surface of the recording medium as variations in the strength of a magnetic field which is oriented parallel to the medium surface. External magnetic fields, such as the magnetic field components associated with a magnetic brush, will have a high degree of interaction with a recorded latent image if they are also oriented parallel to the recording medium surface. Likewise, external magnetic fields will have minimum interaction with a recorded latent image if they are oriented normal to the recording medium surface. The magnetic brush structure of the present invention minimizes magnetic field strength at the surface of the magnetic recording medium and orients the magnetic field components at that point normal to the surface of the recording medium.

Figures 3, 4:
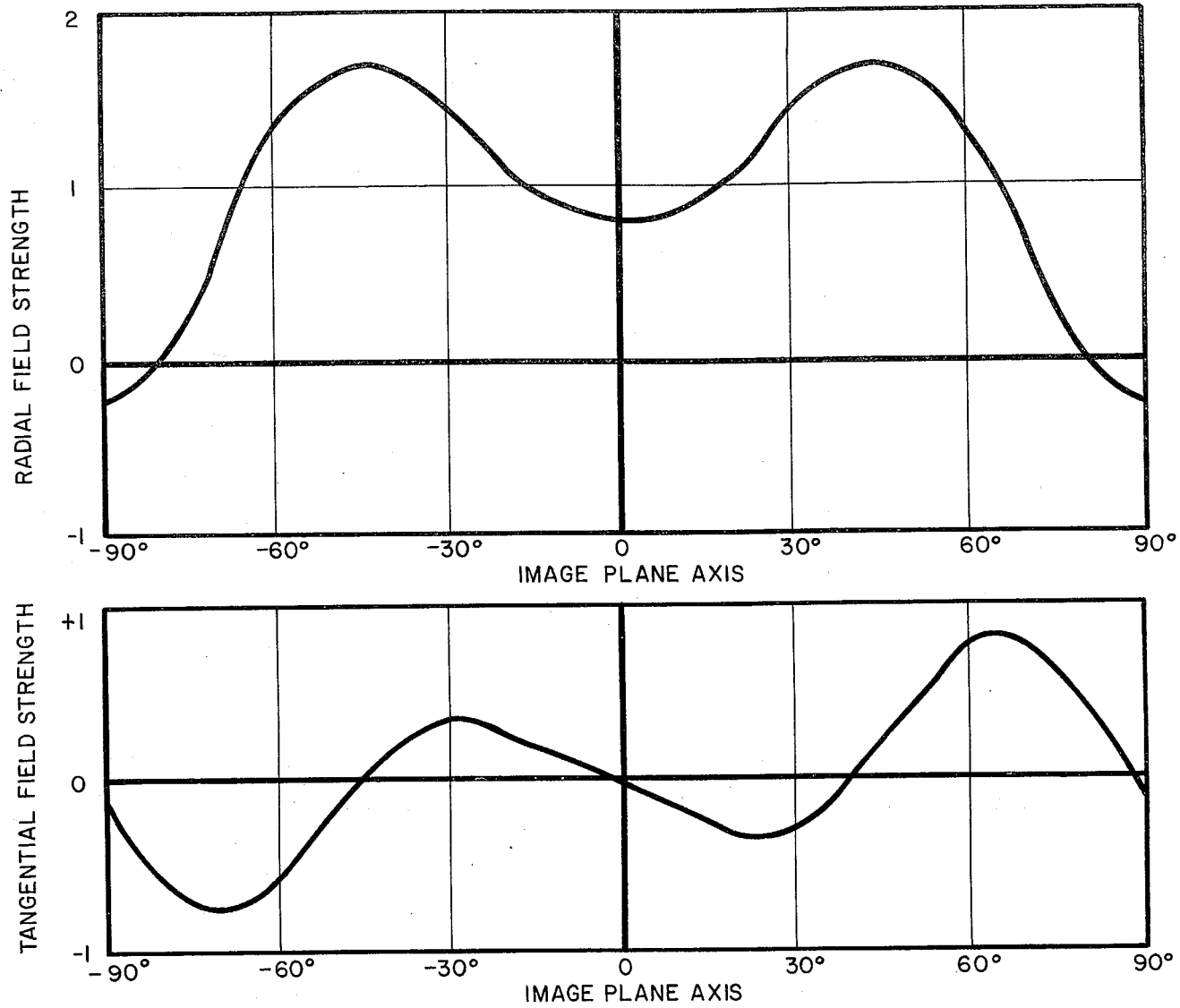
FIG. 3 is a plot of the tangential magnetic field component vs. angle in the magnetic brush of FIG. 2.
FIG. 4 is a plot of the of the radial magnetic field component vs. angle for the magnetic brush of FIG. 2.

FIG. 3 is a tracing of a plot of the tangential magnetic field strength in the vicinity of a magnetic brush of the present invention and illustrates the operation of the brush. The vertical scale of FIG. 3 represents relative magnetic field strength which is plotted as a function of relative angle about the applicator cylinder axis from the surface of the recording medium and on a constant radius from the applicator cylinder axis. The tangential component of the magnetic field; that is, the component which would interact with the latent magnetic image, passes through zero on the angle axis which corresponds to the location of the magnetic recording surface.

FIG. 4 represents a similar plot of the radial magnetic field as a function of angle in the vicinity of the magnetic brush. The radial field is normal to the surface of the magnetic recording medium and has minimum interaction with the latent magnetic image which is recorded with magnetic field components parallel to the medium surface. The radial magnetic field passes through a minimum on the angle axis corresponding to the position of the magnetic recording surface. For a typical magnetic brush of the present invention, the radial magnetic field strength in the vicinity of the surface of the magnetic recording medium is approximately 50 oersteds.

It may be seen that the present invention provides an improved magnetic brush structure which is suitable for use in the application of toner to latent magnetic images in a magnetic printing machine. The magnetic field components associated with the operation of the brush of the present invention are aligned normal to the surface of the magnetic recording medium and have smaller intensities than the magnetic field components associated with brushes of the prior art.

While this invention has been described with reference to a particular embodiment, other modifications and variations will occur to those skilled in the art in view of the above teachings. Accordingly, it should be understood that within the scope of the appended claims, the invention may be practiced otherwise than is specifically described.

The invention claimed is:

1. An improved machine, adapted for applying and removing particulate, ferromagnetic toner onto a surface of a magnetic recording medium, of the type comprising a multi-pole stator of generally prismatic shape; a hollow applicator cylinder rotatably disposed around the stator; and means for exciting the poles of the stator with magnetic fields; wherein, as an improvement:

said stator comprises a plurality of poles radially disposed about the axis of said cylinder;

said plurality of poles comprises two principal poles, said principal poles being disposed closer to said surface of said recording medium than the remainder of said plurality of poles;

said means adapted for exciting said principal poles with magnetic fields having like orientation.

2. The improved machine of claim 1 wherein said principal poles are equi-distant from said surface of said recording medium.

3. The improved machine of claim 2 wherein said means are adapted to excite each of said remainder of said poles with a magnetic field having an orientation opposite from the orientation of the magnetic field of each next adjacent pole.

4. The improved machine of claim 3 wherein said plurality of poles are symmetrically disposed about a plane of symmetry lying normal to said surface of said recording medium and passing through said axis of said cylinder.

5. The improved machine of claim 4 wherein said remainder of said poles comprise a pole disposed most distant from said surface of said recording medium and in said plane of symmetry.

6. The improved machine of claim 2 wherein said means are permanent magnet means.

7. The impoved machine of claim 6 comprising seven poles.

8. The improved machine of claim 7 wherein said principal poles are disposed on radii of said cylinder forming a right angle.

* * * * *